US007290550B2

(12) United States Patent
Sim

(10) Patent No.: US 7,290,550 B2
(45) Date of Patent: Nov. 6, 2007

(54) PAINTING HOLDER, HOLDER FEEDING UNIT, PRINTER UNIT HAVING THE HOLDER AND FEEDING UNIT, AND ART PAINTING APPARATUS HAVING SUCH PAINTER UNIT FOR AUTOMATIC VENDING MACHINES

(75) Inventor: Dong-Hyun Sim, Seoul (KR)

(73) Assignee: D & Tech Co., Ltd., Gyeonggi-Do (KR)

( * ) Notice: Subject to any disclaimer, the term of this patent is extended or adjusted under 35 U.S.C. 154(b) by 119 days.

(21) Appl. No.: 10/491,142

(22) PCT Filed: Apr. 6, 2002

(86) PCT No.: PCT/KR02/00608

§ 371 (c)(1),
(2), (4) Date: Sep. 29, 2004

(87) PCT Pub. No.: WO03/036577

PCT Pub. Date: May 1, 2003

(65) Prior Publication Data

US 2005/0036813 A1 Feb. 17, 2005

(30) Foreign Application Priority Data

Sep. 28, 2001 (KR) ..... 2001-60552

(51) Int. Cl.
*A45D 29/00* (2006.01)
*A45D 29/18* (2006.01)

(52) U.S. Cl. ..... 132/73; 132/73.5; 132/73.6; 132/75; 132/75.8; 132/285; 400/323; 70/158; 101/35

(58) Field of Classification Search ..... 132/73, 132/73.5, 74.5, 285, 75.8, 73.6, 75, 75.3–75.4; 70/158; 101/35, 494; 400/323
See application file for complete search history.

(56) References Cited

U.S. PATENT DOCUMENTS

| | | | | |
|---|---|---|---|---|
| 3,930,388 | A * | 1/1976 | Barras | 70/159 |
| 5,782,379 | A * | 7/1998 | Traub et al. | 221/93 |
| 5,931,166 | A | 8/1999 | Weber et al. | |
| 6,336,694 | B1 * | 1/2002 | Ishizaka | 347/2 |

FOREIGN PATENT DOCUMENTS

| | | | |
|---|---|---|---|
| KR | 2000-75566 | A | 7/1999 |
| KR | 2000-75428 | A | 12/2000 |
| KR | 2000-75566 | A | 12/2000 |

* cited by examiner

*Primary Examiner*—Daniel J. Colilla
*Assistant Examiner*—Marissa Ferguson-Samreth
(74) *Attorney, Agent, or Firm*—Sughrue Mion, PLLC

(57) ABSTRACT

The present invention provides a painting holder, a painting holder feeding unit, a printer unit having the holder and feeding unit, and an art painting apparatus with such a printer unit for automatic vending machines. The painting holder consists of a housing connected to a bracket of a feeding unit, a spring-biased finger base movably set within the housing so as to be elastically biased upward in the housing, a locking member hinged to the right-hand sidewall of the housing, and normally biased in a direction by a first torsion coil spring, and a finger cover hinged to the left-hand sidewall of the housing, and biased in a direction by a second torsion coil spring. The finger cover also has a painting opening at a predetermined position thereof, and is locked by the locking member. The art painting apparatus has a high resolution of not less than 1,200 dpi, thus accomplishing a highly active and clear painting effect. The apparatus also has a simple construction, thereby reducing its production and maintenance cost. This apparatus easily and effectively paints a variety of letters, pictures, patterns, or personally designed characters on desired surfaces, such as users fingernails, faces or arms, or the covers of books or pens, as desired, and thereby allows the users to express their personalities through the painting.

2 Claims, 10 Drawing Sheets

PAINTING HOLDER, HOLDER FEEDING UNIT, PRINTER UNIT HAVING THE HOLDER AND FEEDING UNIT, AND ART PAINTING APPARATUS HAVING SUCH PAINTER UNIT FOR AUTOMATIC VENDING MACHINES

TECHNICAL FIELD

The present invention relates, in general, to a painting holder, a painting holder feeding unit, a printer unit having the holder and feeding unit, and an art painting apparatus with such a printer unit for automatic vending machines, and, more particularly, to an art painting apparatus for automatic vending machines, which has a printer unit consisting of a painting holder and a painting holder feeding unit, and paints a variety of clear patterns, having a high resolution of not less than 1,200 dpi, on a desired surface, thus accomplishing a highly active and clear painting effect, and which has a simple construction and is easily operated, thus reducing its production cost. The art painting apparatus is not likely to be broken during its operation, and so the maintenance cost of the apparatus is reduced, thus improving the economic efficiency of the art painting apparatus. The art painting apparatus easily and effectively paints a variety of letters, pictures, patterns, or personally designed characters on desired surfaces, such as users fingernails, faces or arms, or the covers of books or pens, as desired, and thereby allows the users to express their personalities through the painting.

BACKGROUND ART

As well known to those skilled in the art, a body painting is an act wherein desired pictures or patterns are painted on the naked human body, such as the face or desired parts of the body. Nail art is an act wherein desired pictures or patterns are painted on the trimmed and polished fingernails. In recent years, such a body painting and nail art are performed to express people's personalities.

Body art, such as body painting and nail art, is a kind of traditional custom, and involves an act wherein indelible patterns or pictures are tattooed on the human body, or removable patterns or pictures are painted on the human face or the human body using natural plant dyes or mud.

Such traditional body art was limitedly performed at religious services or ritual ceremonies, and was sometimes performed in combination of arcane ceremonies.

For example, traditional body painting was performed at a coming-of-age ceremony of men of several tribes of the South Pacific Ocean Islands, such as Polynesian tribes, New Caledonian tribes, Maoris of New Zealand, Dafoos, Nagas and Abols of Assam.

In addition, several tribes of South America, such as Guanas, Nambiquaras and Bororos, paint delicate geometrical patterns or asymmetric Arabic patterns on their faces or bodies.

A French anthropologist, C. Revistros, reported that the face painting of the above-mentioned tribes was a means for exhibiting the social status of people.

Tattooing is the act or practice of marking the skin with indelible patterns, pictures, legends, letters, etc., by making punctures in it and inserting pigments. In advanced societies, tattooing is mainly performed as a body decorating means, or a means for expressing one's personality.

Examples of sentimental patterns or pictures typically used in tattoos are hearts penetrated by arrows, hearts locked by locks, names, flowers, flags, etc. Examples of superstitious patterns or pictures typically used in tattoos are horseshoes, clovers, etc. Examples of revenge patterns or pictures typically used in tattoos are skeletons, wounded heads, coffins, hearts encircled by snakes, etc.

The tattoos worn by hoodlums or prisoners are generally violent and offensive. Some hoodlums or prisoners tattoo lewd, lascivious or coarse patterns or pictures on their pubic regions. Occasionally, such tattooing is performed as a means for expressing the member's rank in a criminal organization.

In recent years, eyebrow tattooing for making dark eyebrows, eyelid tattooing for decorating the eyelids, and lip line tattooing for making dark lip lines are widely performed as cosmetic treatments.

However, tattooing is problematic in that the tattooed patterns, pictures or legends are indelible, and so it is almost impossible to remove them from the human body, different from the removable patterns and pictures produced by the body painting or nail art.

In the act of body painting, persons can paint desired patterns, pictures or letters on desired parts of their bodies by themselves, but cannot paint the patterns, pictures or letters on the parts of their bodies, such as the backs, which are not directly viewed by the persons. In addition, it is necessary for a person, wanting to paint patterns, pictures or letters on his/her face, to see a mirror while painting, and so the person must be highly skilled in the face painting. Therefore, it is almost impossible for unskilled persons to paint desired pictures, patterns or letters on their faces by themselves without the assistance of skilled persons.

In nail art wherein desired pictures, patterns or letters are painted on the trimmed and polished fingernails, it is almost impossible for unskilled persons to paint the pictures, patterns or letters on their fingernails. Furthermore, even though a person is highly skilled in the nail art painting, he/she cannot easily or conveniently paint desired patterns, pictures, or letters on the fingernails of his/her both hands as follows: That is, when the person skilled in the nail art painting is a left-handed person, he/she cannot easily or conveniently paint the desired pictures, patterns, or letters on the fingernails of his/her left hand. In the same manner, when the skilled person is a right-handed person, he/she cannot easily or conveniently paint the desired pictures, patterns, or letters on the fingernails of his/her right hand.

In an effort to allow persons to easily and conveniently paint desired patterns, pictures or letters on their fingernails while overcoming the above-mentioned problems, Japanese Patent Laid-open Publication No. Heisei. 6-70810 proposed a method and device for nail art. In this Japanese method and device provides a thin sheet printed with desired nail art patterns, pictures or letters. In order to use the thin sheet, the sheet is cut into pieces having sizes agreeing with the sizes of users fingernails, and the pieces are attached to the fingernails to accomplish a nail art effect. However, the nail art pieces of such a thin sheet, printed with desired nail art patterns, pictures or letters, are attached to the fingernails by means of a bonding agent applied on the lower surface of the sheet, and so the pieces are easily removed from the fingernails, and contaminate the fingernails by the residue of the bonding agent.

In an effort to overcome the problems experienced in the above Japanese method and device, Korean Patent Laid-open Publication No. 2000-75566 proposed method and apparatus for nail art. In the nail art method of the above Korean patent, one or more fingers of a user are primarily held on a finger holder of the nail art apparatus such that the fingernails are stably positioned on the holder. Thereafter, one or more of the nail art patterns stored in a control unit of the nail art apparatus are selected by the user. After selecting desired nail art patterns, at least one of the finger holder and a printer unit is moved to a predetermined printing position by a feeding unit operated under the control of the control unit. At the predetermined printing position, the printer unit prints the selected nail art patterns on the fingernails.

The nail art apparatus disclosed in the above Korean patent consists of the finger holder for supporting one or more fingers of a user thereon, and the control unit storing a plurality of nail art patterns therein and allowing the user to select one or more of the stored patterns prior to printing the patterns on his/her fingernails. The apparatus also has the printer unit, which is operated under the control of the control unit and prints the selected patterns on the fingernails of the user. The apparatus further includes the feeding unit, which is operated under the control of the control unit in the same manner as that described for the printer unit and feeds at least one of the finger holder and the printer unit to a predetermined printing position. In an operation of the nail art apparatus, the control unit operates the feeding unit to move at least one of the finger holder and the printer unit relative to the other, thus allowing the printer unit to print selected nail art patterns on the fingernails at the predetermined printing position.

However, the above-mentioned Korean nail art method and apparatus only provides a low resolution of about 300 dpi of the printer unit, thus providing only a low printing quality. Therefore, this method and apparatus does not form clear patterns of a desirably high resolution on the fingernails, but only provides obscure patterns of a low resolution.

Another problem of the above Korean nail art method and apparatus resides in that the apparatus has a complex construction, and so it is very difficult to operate the apparatus. Due to such a complex construction, the apparatus also increases its production cost and the elements of the apparatus are frequently broken during an operation of the apparatus. The nail art apparatus thus increases its maintenance cost, and reduces its economic efficiency. This nail art method and apparatus is thus not widely used in the nail art field.

DISCLOSURE OF THE INVENTION

Accordingly, the present invention has been made keeping in mind the above problems occurring in the prior art, and an object of the present invention is to provide a painting holder, a painting holder feeding unit, a printer unit having the holder and feeding unit, and an art painting apparatus with such a printer unit for automatic vending machines, in which the printer unit, consisting of the painting holder and the painting holder feeding unit, paints a variety of clear patterns, having a high resolution of 900~3,600 dpi, preferably not less than 1,200 dpi, on a desired surface, thus accomplishing a highly active and clear painting effect, wherein the art painting apparatus has a simple construction and is easily operated, thus reducing its production cost, and is not likely to be broken during its operation, thus reducing its maintenance cost and improving its economic efficiency, and wherein the art painting apparatus easily and effectively paints a variety of pictures, patterns, or personally designed characters on desired surfaces, such as users fingernails, faces or arms, or the covers of books or pens, as desired, thereby allowing the users to express their personalities through the painting.

In order to accomplish the above objects, the present invention provides a painting holder for art painting apparatuses, comprising: a box-shaped housing opened at the top thereof and connected at the rear portion thereof to a bracket of a painting holder feeding unit; a spring-biased finger base movably set within the housing, with a compression coil spring held at the bottom surface of the finger base by a setscrew so as to elastically bias the finger base upward in a vertical direction within the housing; a locking member rotatably mounted at a first end thereof to the external surface of a right-hand sidewall of the housing using a first hinge pin, and normally biased in a direction by a first torsion coil spring, a second end of the locking member being positioned at an upper portion of the housing; and a finger cover hinged at a first end thereof to the external surface of a left-hand sidewall of the housing using a second hinge pin, and biased in a direction by a second torsion coil spring, the finger cover also having a painting opening at a predetermined position thereof, and locked at a second end thereof by the second end of the locking member.

The present invention also provides a painting holder feeding unit for art painting apparatuses, comprising: a stepping motor supported on a rear portion of a gear frame, and used for driving a first reduction gear, a second reduction gear and a belt drive gear; a timing belt set within a tray frame and operated in conjunction with the belt drive gear such that the timing belt is rotated under the guide of a tray guide shaft; a belt roller set within the tray frame while being biased by a coil spring, the belt roller biasing the timing belt in a direction to appropriately tension the belt; a painting position sensor and a stop position sensor installed in the tray frame at front and rear positions, and used for determining a linear movement range of the timing belt; and a bracket provided at a front portion of a tray for connecting a painting holder to the front portion of the tray, thus allowing the painting holder to move along with the tray in the same direction.

The present invention further provides a printer unit for art painting apparatuses, comprising signal input terminals for receiving input signals, an ink cartridge having an ink nozzle for spraying ink to a desired position, a control unit controllably operating the ink cartridge in response to input signals received by the signal input terminals, and a cartridge guide rail detachably seating the ink cartridge thereon and guiding a reciprocating movement of the ink cartridge linear, further comprising: a painting holder feeding unit consisting of: a stepping motor supported on a rear portion of a gear frame, and used for driving a first reduction gear, a second reduction gear and a belt drive gear; a timing belt set within a tray frame and operated in conjunction with the belt drive gear such that the timing belt is rotated under the guide of a tray guide shaft; a belt roller set within the tray frame while being biased by a coil spring, the belt roller biasing the timing belt in a direction to appropriately tension the belt; a painting position sensor and a stop position sensor installed in the tray frame at front and rear positions, and used for determining a linear movement range of the timing belt; and a bracket provided at a front portion of a tray for connecting the painting holder to the front portion of the tray, thus allowing the painting holder to move along with the tray in the same direction; and the painting holder consisting of: a box-shaped housing opened at a top thereof and connected at a rear portion thereof to the bracket of the painting holder feeding unit; a spring-biased finger base movably set within the housing, with a compression coil spring held at a bottom surface of the finger base by a setscrew so as to elastically bias the finger base upward in a vertical direction within the housing; a locking member rotatably mounted at a first end thereof to an external surface of a right-hand sidewall of the housing using a first hinge pin, and normally biased in a direction by a first torsion coil spring, a second end of the locking member being positioned at an upper portion of the housing; and a finger cover hinged at a first end thereof to an external surface of a left-hand sidewall of the housing using a second hinge pin, and biased in a direction by a second torsion coil spring, the finger cover also having a painting opening at a predetermined position thereof, and locked at a second end thereof by the second end of the locking member.

The present invention also provides an art painting apparatus for automatic vending machines, designed such that a user lays an object to be painted on a painting holder, selects one or more painting patterns from a storing unit by operating an input unit while confirming the selected patterns displayed on a displaying unit, moves a printer unit or the object to a painting position by means of a feeding unit operated under the control of a control unit, thus allowing the printer unit to paint the selected patterns on the object, wherein the feeding unit comprises: a stepping motor supported on a rear portion of a gear frame, and used for driving a first reduction gear, a second reduction gear and a belt drive gear; a timing belt set within a tray frame and operated in conjunction with the belt drive gear such that the timing belt is rotated under the guide of a tray guide shaft; a belt roller set within the tray frame while being biased by a coil spring, the belt roller biasing the timing belt in a direction to appropriately tension the belt; a painting position sensor and a stop position sensor installed in the tray frame at front and rear positions, and used for determining a linear movement range of the timing belt; and a bracket provided at a front portion of a tray for connecting the painting holder to the front portion of the tray, thus allowing the painting holder to move along with the tray in the same direction.

In an embodiment of this invention, the object to be painted is a human finger; and the painting holder is a finger holder comprising: a box-shaped housing opened at a top thereof and connected at a rear portion thereof to the bracket of the feeding unit; a spring-biased finger base movably set within the housing, with a compression coil spring held at a bottom surface of the finger base by a setscrew so as to elastically bias the finger base upward in a vertical direction within the housing; a locking member rotatably mounted at a first end thereof to an external surface of a right-hand sidewall of the housing using a first hinge pin, and normally biased in a direction by a first torsion coil spring, a second end of the locking member being positioned at an upper portion of the housing; and a finger cover hinged at a first end thereof to an external surface of a left-hand sidewall of the housing using a second hinge pin, and biased in a direction by a second torsion coil spring, the finger cover also having a painting opening at a predetermined position thereof, and locked at a second end thereof by the second end of the locking member.

In another embodiment of this invention, the object to be painted is a human face; and the painting holder is a strip-shaped face holder designed to hold the forehead and chin of the face, the face holder being connected to the bracket of the feeding unit.

In a further embodiment of this invention, the object to be painted is a human arm; and the painting holder is an arm holder formed as a hollow cylindrical member defining a bore for receiving the arm therein, the arm holder being connected to the bracket of the feeding unit.

In still another embodiment of this invention, the object to be painted is a cover of a book; and the painting holder is a book holder made of a plate, with a position adjusting unit included in the book holder for adjusting a vertical position of the book holder such that the cover of the book is placed at a desired height, the book holder being connected to the bracket of the feeding unit.

In still another embodiment of this invention, the object to be painted is a pen; and the painting holder is a pen holder having a longitudinal cylinder-shaped body, which has a pen inlet for inserting the pen into the pen holder and is designed to prevent an undesired movement of the pen in the pen holder, with a position adjusting unit included in the pen holder for adjusting a vertical position of the pen holder such that the pen is placed at a desired height, the pen holder being connected to the bracket of the feeding unit.

In the art painting apparatus of this invention, the position adjusting unit comprises: a height sensor for sensing a height of the object to be painted; a rack vertically fixed to a lower surface of the painting holder; a pinion gear engaging with the rack; and a reversible motor connected to the pinion gear so as to rotate the pinion gear such that the rack moves upward or downward in a vertical direction to place an upper surface of the object at a predetermined position where the object is painted, whereby the bracket of the feeding unit is connected to a rear portion of the position adjusting unit.

In the art painting apparatus, the printer unit is an inkjet-type color printer having a resolution of 900~3,600 dpi.

BRIEF DESCRIPTION OF THE DRAWINGS

The above and other objects, features and other advantages of the present invention will be more clearly understood from the following detailed description taken in conjunction with the accompanying drawings, in which:

FIGS. 4*a* and 4*b* are sectional views of the finger holder of the art painting apparatus in accordance with the primary embodiment of the present invention, in which:

FIG. 4*a* shows the finger holder when a finger cover of the holder is opened to allow a users finger to be laid on a finger base; and FIG. 4*b* shows the finger holder when the finger cover is completely locked by a locking member to fix the position of the users finger on the finger base;

BEST MODE FOR CARRYING OUT THE INVENTION

Figure 1:
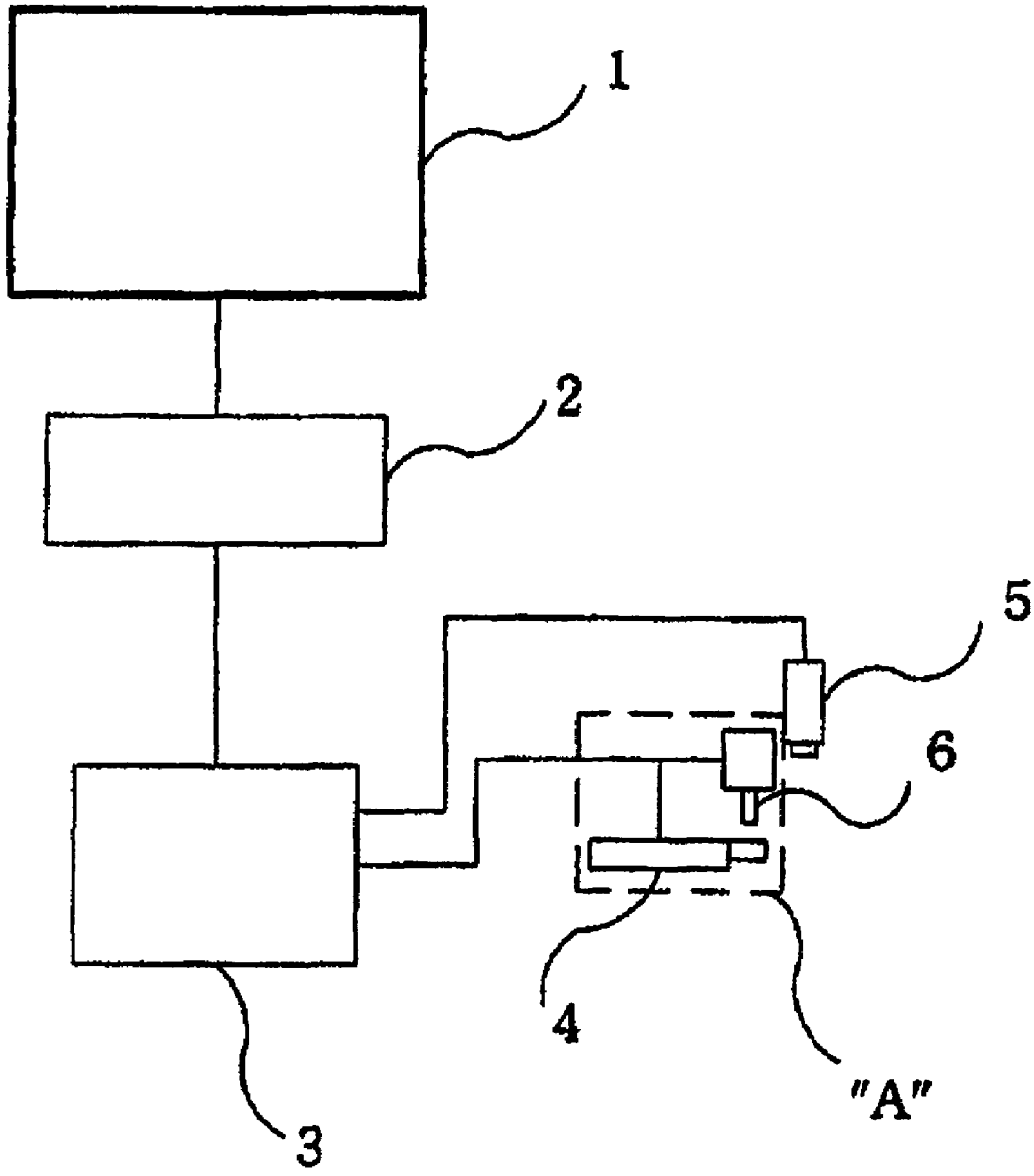
FIG. 1 is a block diagram of an art painting apparatus for automatic vending machines in accordance with the preferred embodiment of the present invention.

Reference should now be made to the drawings, in which the same reference numerals are used throughout the different drawings to designate the same or similar components.

FIG. 1 is a block diagram of an art painting apparatus for automatic vending machines in accordance with the preferred embodiment of the present invention. As shown in the drawing, the art painting apparatus of this invention comprises a plurality of elements, such as a monitor 1 used as a display unit, a control panel 2 used as a data input unit, a camera 5 used for producing images of painted pictures or letters and allowing users to view the images displayed on the monitor 1, and a printer unit "A" used as a painting unit. The art painting apparatus also has a circuit board 3 used as a control unit for processing data and controlling the operation of the elements during an art painting process. The monitor 1, control panel 2, camera 5, printer unit "A", and circuit board 3 are connected to each other to accomplish a communication between them.

The printer unit "A" comprises an ink cartridge having an ink nozzle 6 for spraying ink to a desired position. That is, the ink nozzle 6 sprays ink onto a users body to paint a variety of letters, patterns and/or pictures on the body. The printer unit "A" also has signal input terminals for receiving input signals, and a cartridge guide rail for detachably seating the ink cartridge thereon and guiding a reciprocating movement of the ink cartridge. The control unit 3 controllably operates the ink cartridge in response to input signals received by the signal input terminals. In order to stabilize a desired part of the users body to be painted with pictures or letters during an art painting process, the printer unit "A" further includes a painting holder. In the primary embodiment of this invention, a finger holder 7 designed to hold a users finger thereon, is used as the painting holder. The printer unit "A" also has a painting holder feeding unit 4 for feeding the painting holder to a painting position aligned with the printer's ink nozzle 6 inside the apparatus.

Figure 2A:
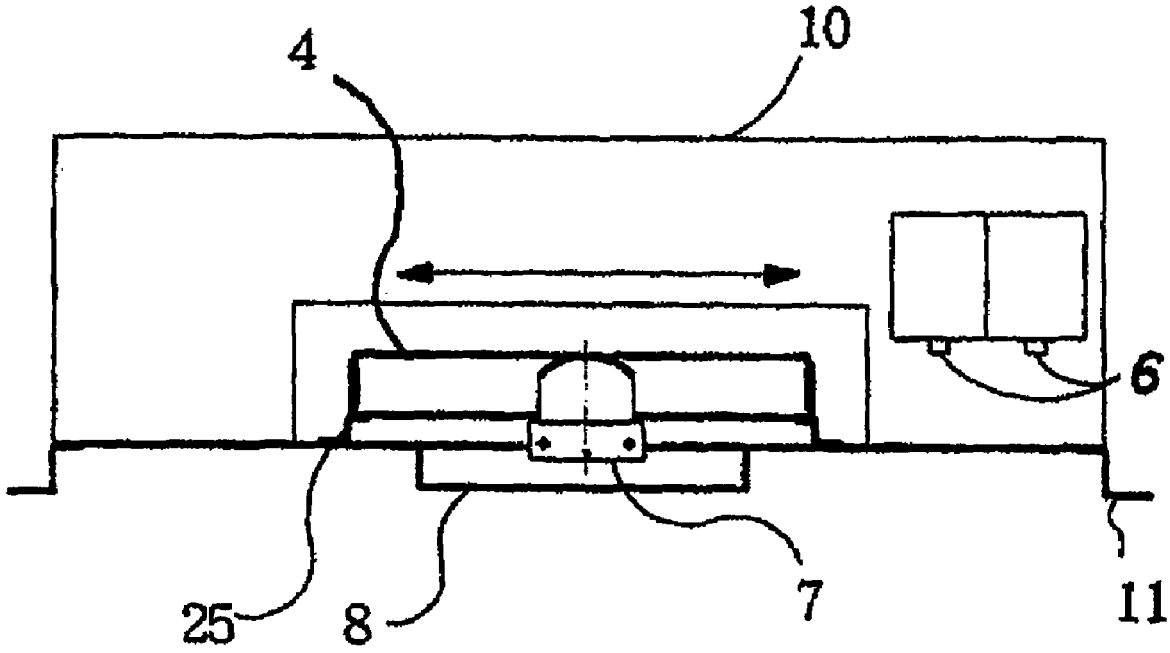
FIG. 2*a* is a front view of a printer unit included in the art painting apparatus in accordance with the primary embodiment of this invention.
Figure 2B:
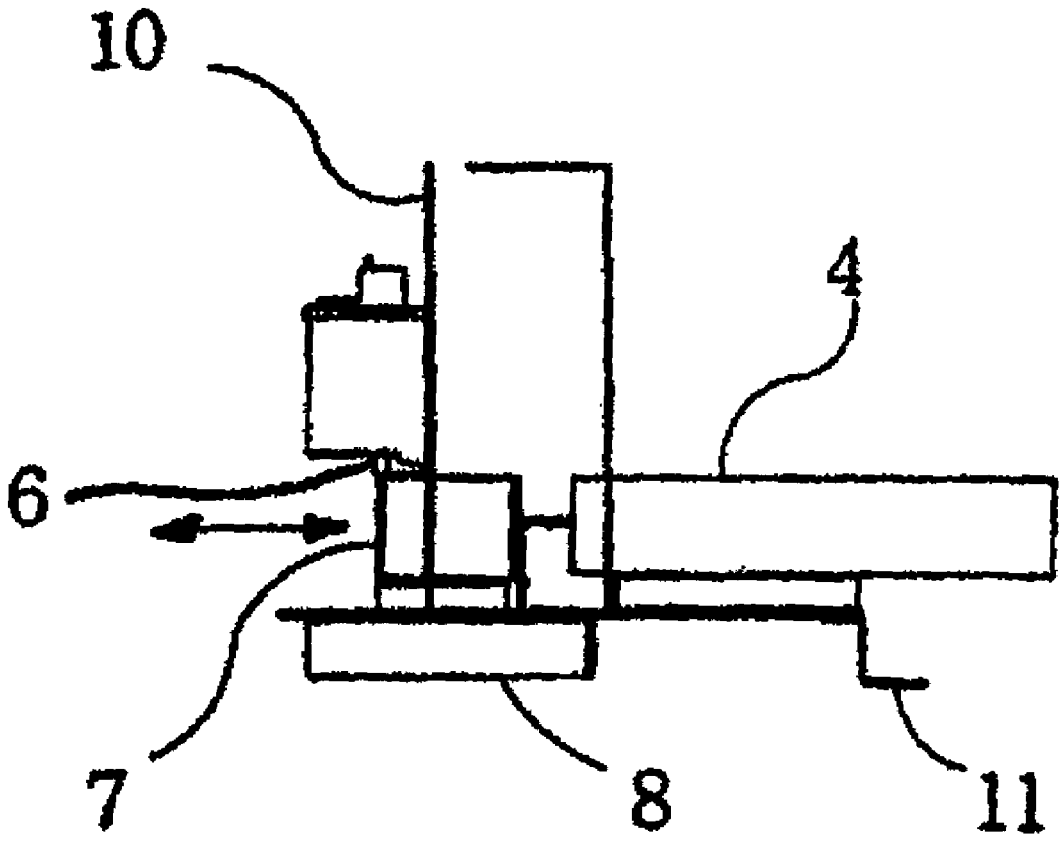
FIG. 2*b* is a side view of the printer unit of FIG. 2*a;*

FIG. 2*a* is a front view of the printer unit included in the art painting apparatus in accordance with the primary embodiment of the present invention. FIG. 2*b* is a side view of the printer unit of FIG. 2*a*. As shown in the drawings, the ink nozzle 6 is mounted on the frame 10 of the printer unit "A", and linearly reciprocates to the left and right as shown by the arrow of FIG. 2*a*. The painting holder feeding unit 4 is mounted on the base 9 of the printer unit "A" through a tray frame bracket 25.

The finger holder 7 is mounted to the feeding unit 4 through a bracket 20 (see FIG. 5), and is mechanically characterized in that it linearly reciprocates forward and backward as shown by the arrow of FIG. 2*b*.

A holder support 8 is provided at the bottom of the finger holder 7 for stably holding the use's finger and preventing an undesired movement of the finger during a process of painting the fingernail performed by the printer unit "A". A printer support bracket 11 is provided at each end of the printer frame 10.

Figure 3:
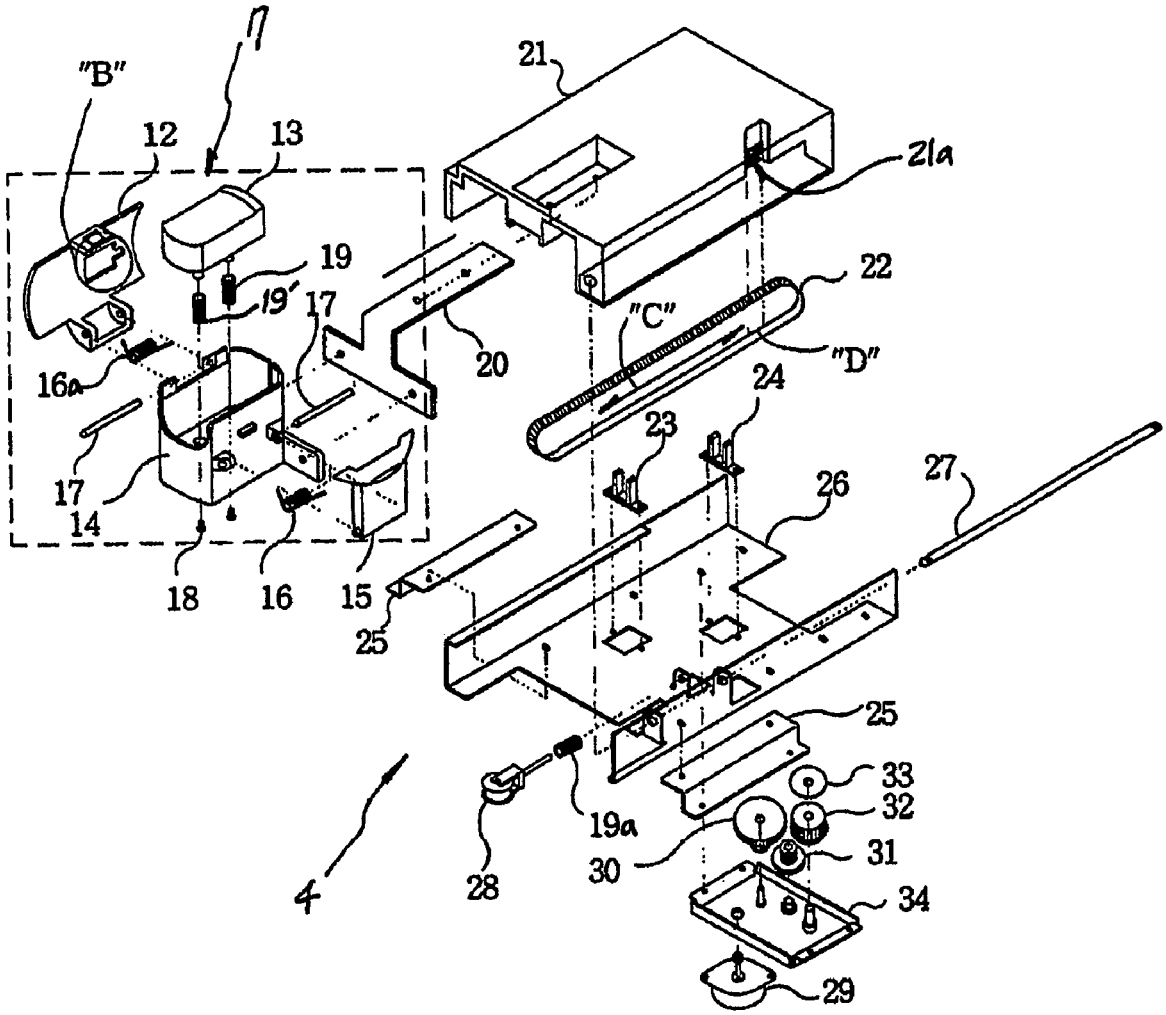
FIG. 3 is an exploded perspective view, showing the construction of the finger holder and a holder feeding unit included in the art painting apparatus in accordance with the primary embodiment of the present invention.

FIG. 3 is an exploded perspective view, showing the construction of the finger holder and its feeding unit included in the art painting apparatus of the present invention. The finger holder 7 has a box shape with a rectangular cross-section as defined within the closed phantom line of FIG. 3. That is, the finger holder 7 consists of a box-shaped housing 14, which is opened at its top and receives a spring-biased finger base 13 therein. The finger base 13 is movably set within the housing 14. In such a case, two compression coil springs 19 and 19*a* are mounted to the bottom surface of the finger base 13 using two setscrews 18, and so the finger base 13 is normally elastically biased upward in a vertical direction within the housing 14.

A locking member 15 is rotatably mounted to the external surface of the right-hand sidewall of the housing 14 using a first hinge pin 17, and is normally biased in a direction by a first torsion coil spring 16. A finger cover 12 is hinged to the external surface of the left-hand sidewall of the housing 14 using a second hinge pin 17*a*, and is normally biased in a direction by a second torsion coil spring 16*a*. The finger cover 12 has a painting opening "B".

The painting holder feeding unit 4 is moved by a rotating force of a stepping motor 29, which is supported on a gear frame 34. The rotating force of the stepping motor 29 is primarily transmitted to a timing belt 22 through a gear transmission mechanism, consisting of a first reduction gear 30, a second reduction gear 31 and a belt drive gear 32, while being substantially reduced in its rotating speed.

That is, the timing belt 22, which receives the reduced rotating force of the stepping motor 29, is appropriately tensioned by a belt roller 28 that is set within the tray frame 26 while being biased by a coil spring 19*a*. This timing belt 22 is set within the tray 21, and is operated in conjunction with the belt drive gear 32. In such a case, the timing belt 22 engages with the belt drive gear 32 through a locking washer 33.

The timing belt 22 is preferably made of rubber, and is locked to a belt locking part 21*a* of the tray 21. Both the belt roller 28 and the belt drive gear 32 normally apply an appropriate tensile force to the belt 22, thus tensioning the belt.

The linear movement of the timing belt 22 is effective within a range "C", and is controlled by both a painting position sensor 23 and a stop position sensor 24 which are installed in the tray frame 26.

The tray 21 is assembled with the tray frame 26 such that the tray 21 is moved relative to the tray frame 26 under the guide of a tray guide shaft 27, which is longitudinally set within a side of the tray frame 26. The tray 21 also has the belt locking part 21*a* at which the timing belt 22 is locked to the tray 21.

Therefore, the linear movement of the timing belt 22 allows a linear movement of the tray 21. In such a case, the tray guide shaft 27 guides a linear movement of the tray 21, and so the tray 21 precisely moves during its reciprocating movement.

The finger holder 7 and the feeding unit 4 are connected to each other by the bracket 20, and so the finger holder 7 is moved along with the feeding unit 4 in the same direction.

The finger holder 7 is positioned outside the art painting apparatus, and so a user, wanting to paint his/her fingernail, lays his/her finger on the finger holder 7 placed at a first position outside the art painting apparatus, and fixes the position of the finger on the holder 7 by locking the finger cover 12 to the locking member 15. Thereafter, the finger holder 7 with the users finger retracts to the painting position inside the art painting apparatus, and advances to the first position outside the apparatus after finishing a desired fingernail painting process.

Therefore, the art painting apparatus of this invention does not force a user to insert his/her finger to the painting position inside the apparatus and withdraw the finger from the painting position after a fingernail painting process. The art painting apparatus of this invention is thus convenient to users wanting to paint their fingernails.

In addition, this art painting apparatus allows a user to easily adjust the position of his/her finger on the finger holder 7 to adjust the painted position of the fingernail while seeing the fingernail through the opening "B" of the cover 12. The painting position sensor 23 determines the optimal painted position of the users fingernail.

Figure 4A:
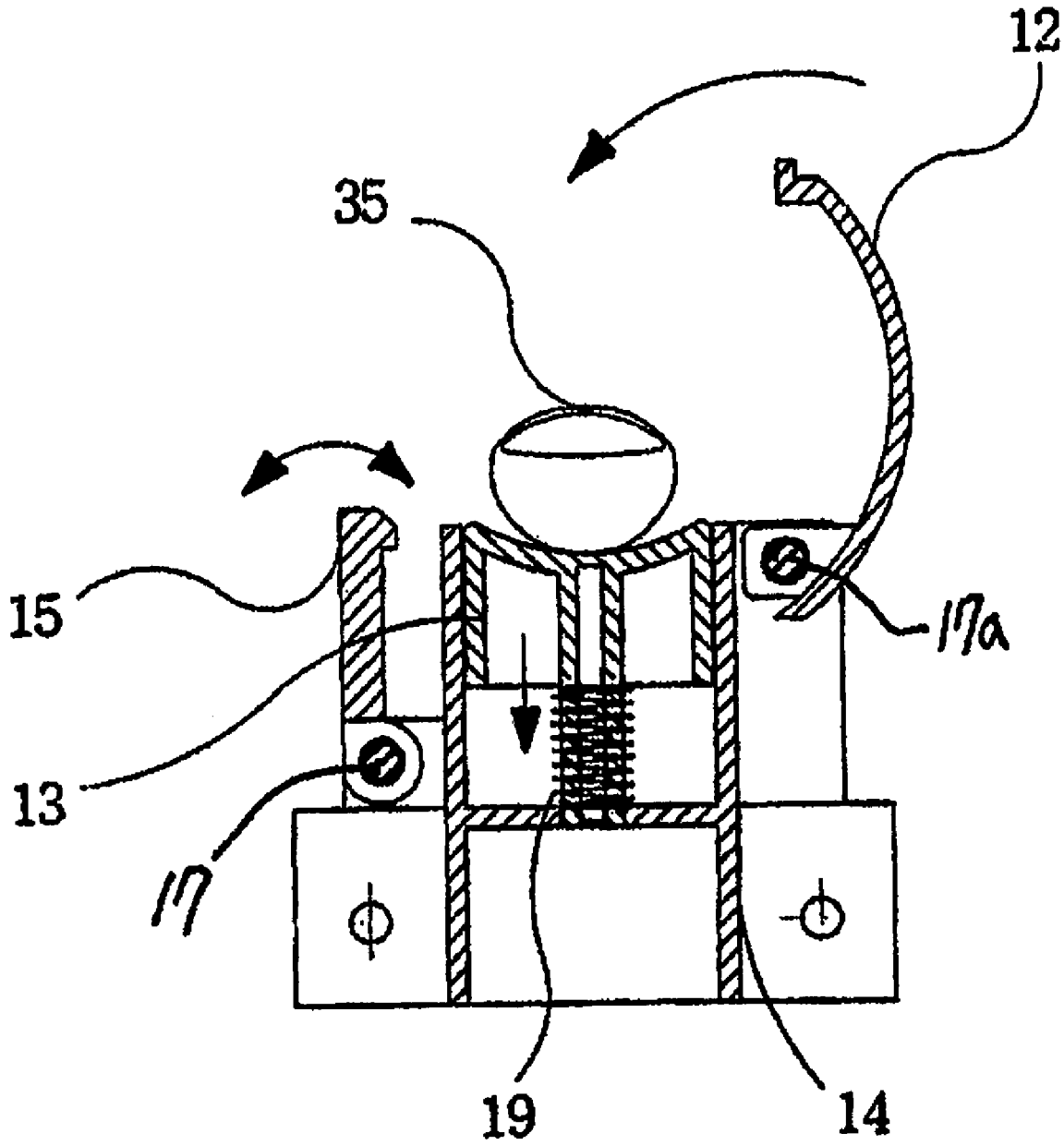

FIG. 4*a* is a sectional view of the finger holder when the finger cover is opened to allow a users finger to be laid on the finger base of the finger holder. As shown in the drawing, a users finger 35 is laid on the finger base 13 after the finger cover 12 is opened. After laying the finger 35 on the finger base 13, the open finger cover 12 is rotated in a direction as shown by the arrow of the drawing, and is locked by the locking member 15. In such a case, the user must check the position of the fingernail relative to the painting opening "B" of the cover 12 prior to locking the cover 12 by the locking member 15.

Figure 4B:
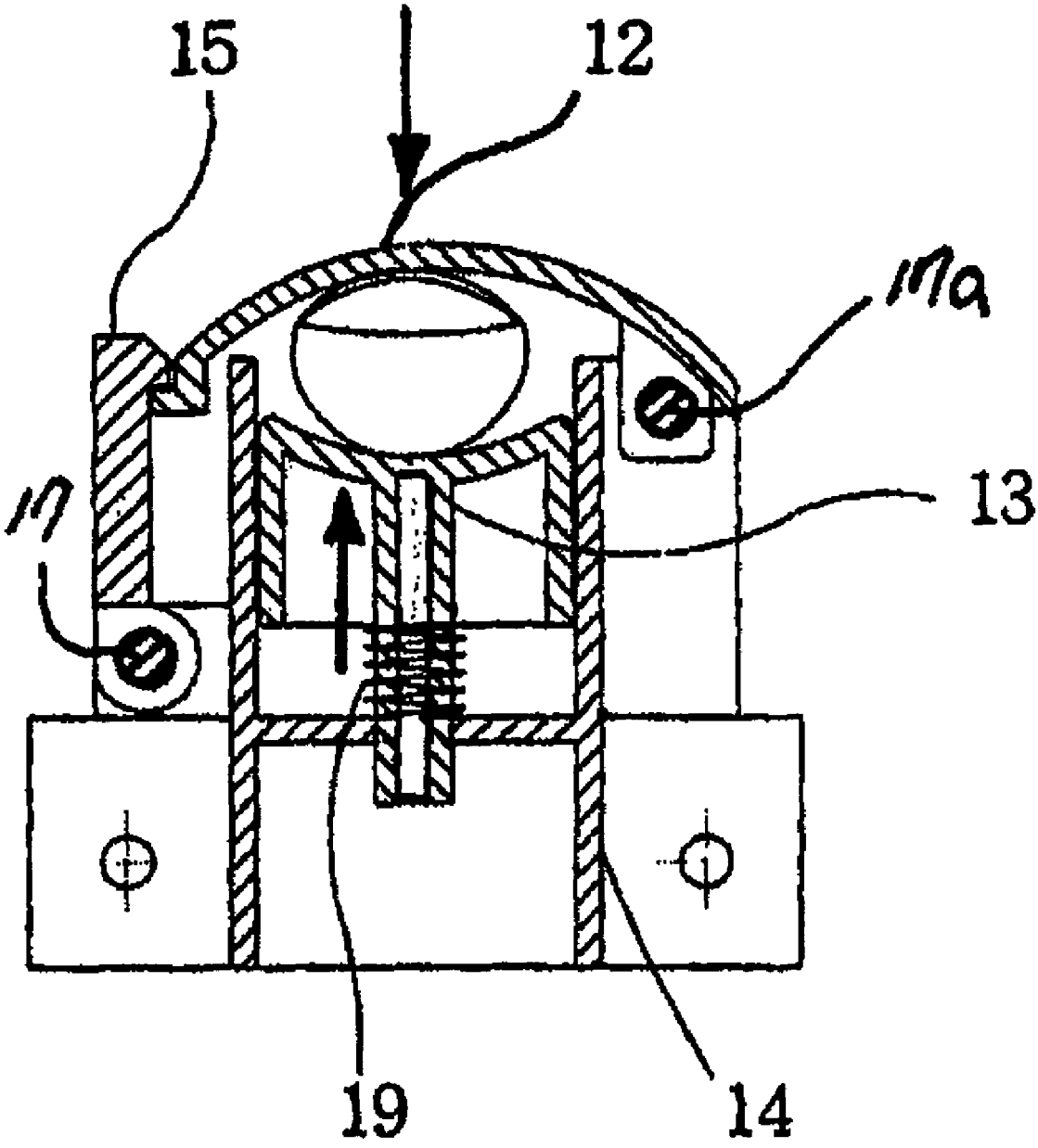

FIG. 4*b* is a sectional view of the finger holder when the finger cover is completely locked by the locking member to fix the position of the users finger on the finger base of the finger holder. When the position of the users finger 35 on the finger base 13 of the finger holder 7 is fixed by the cover 12, the finger base 13 biases the finger 35 upwardly by the restoring force of the two compression coil springs 19 and 19' as shown by the upward arrow of the drawing, while the locked cover 12 biases the finger 35 downwardly as shown by the downward arrow. The users finger 35 is not likely to undesirably move to the left or right in the finger holder during a fingernail painting process of the apparatus.

The art painting apparatus of this invention thus almost completely prevents an undesired movement of a users finger in the finger holder when the printer unit "A" performs a process of painting pictures or letters on the fingernail. It is thus possible for the art painting apparatus to accomplish a highly improved painting quality.

Figure 5:
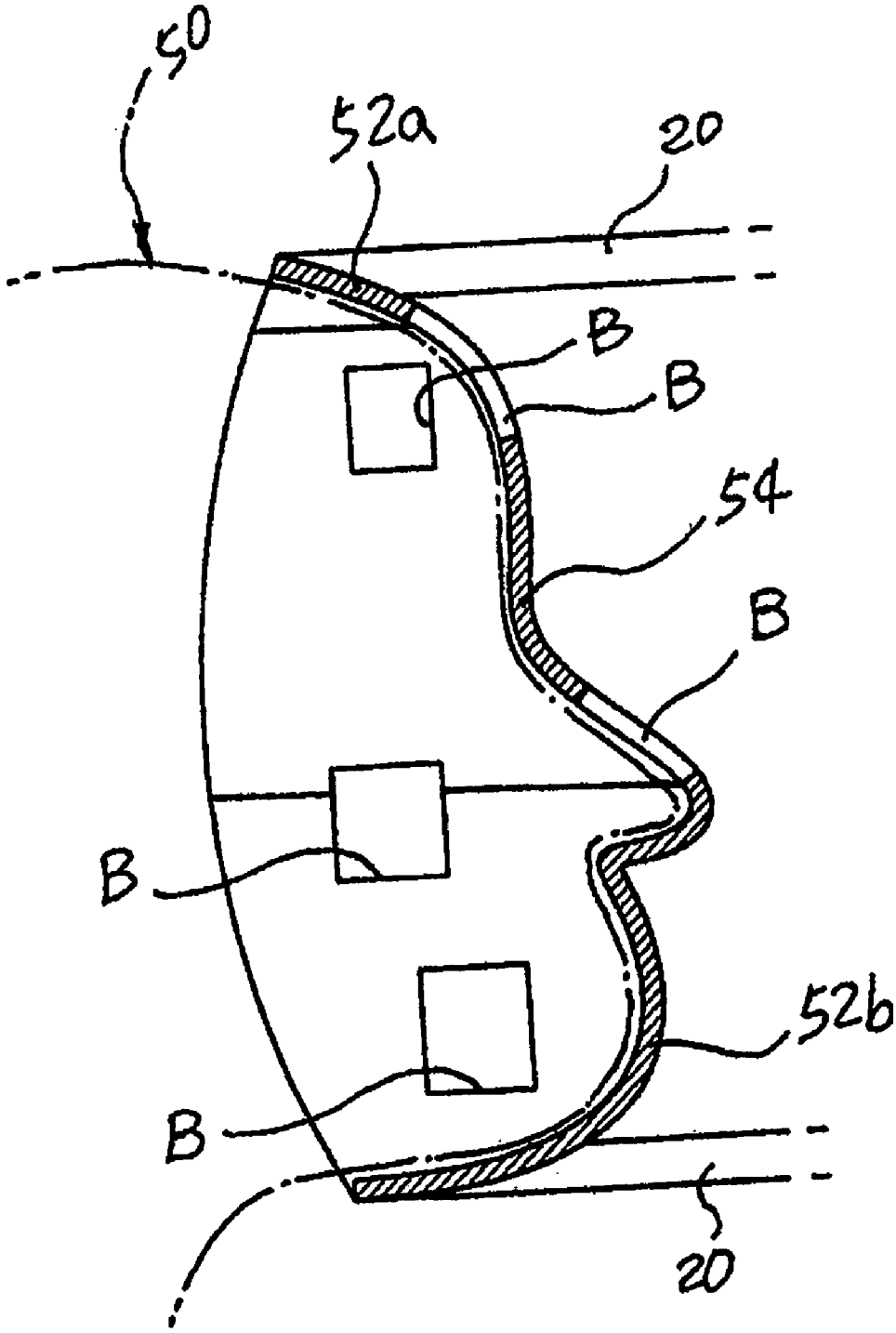
FIG. 5 is a sectional view of a face holder included in the art painting apparatus in accordance with the second embodiment of the present invention.

FIG. 5 is a sectional view of a face holder included in the art painting apparatus in accordance with the second embodiment of the present invention. As shown in the drawing, the face holder, designated by the reference numerals 52*a* and 52*b*, is a model panel shaped to correspond to the profile of a human face, with a plurality of painting openings "B" formed on the face holder at a plurality of desired positions corresponding to the forehead and cheeks of a users face 50. The face holder preferably has a strip-shaped holder, which holds the forehead and chin of the users face 50 and has a cover 54 for covering the eyes, nose and mouth of the user to protect the eyes, nose and mouth from paint during a face art painting process. The above face holder 52*a* and 52*b* is connected to the bracket 20 of the painting holder feeding unit 4.

Figure 6:
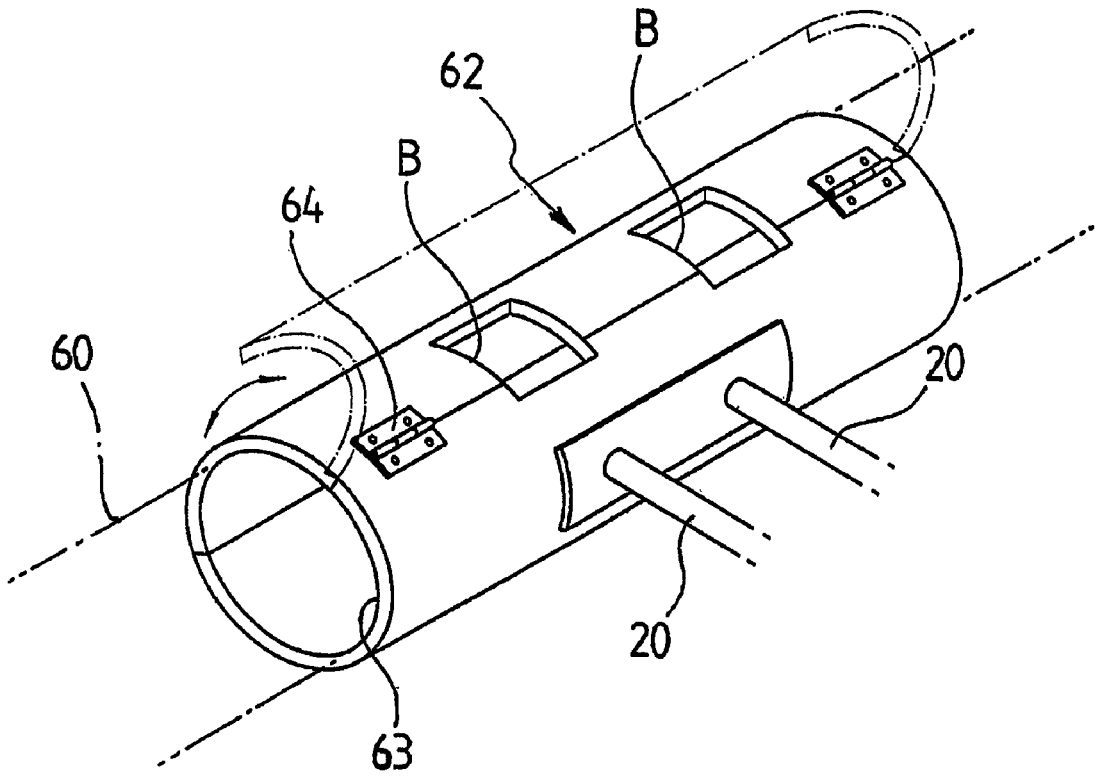
FIG. 6 is a perspective view of an arm holder included in the art painting apparatus in accordance with the third embodiment of the present invention.

FIG. 6 is a perspective view, showing an operation of an arm holder included in the art painting apparatus in accordance with the third embodiment of the present invention. As shown in the drawing, the arm holder 62 is a hollow cylindrical member defining a bore 63 for receiving a users arm therein, with one or more painting openings "B" formed at one or more positions of the holder 62. The arm holder 62 comprises two parts, which have an arc-shaped cross-section and are hinged to each other by a plurality of hinges 64 at a junction thereof. The arm holder 62 is thus opened or closed to receive a users arm 60 therein. This arm holder 62 is mounted at an end thereof to the bracket 20 of the painting holder feeding unit 4.

Figure 7:
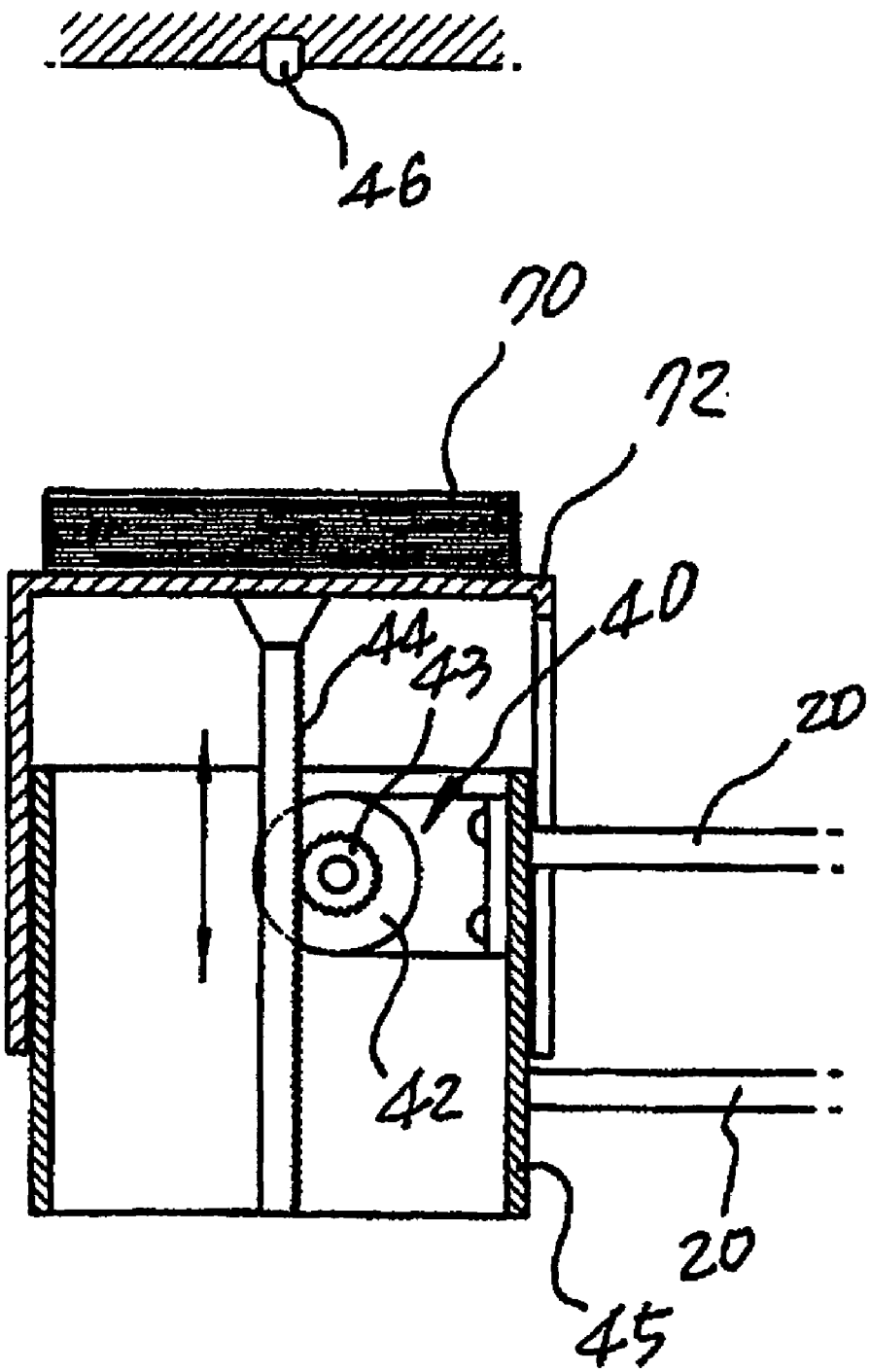
FIG. 7 is a sectional view of a book holder included in the art painting apparatus in accordance with the fourth embodiment of the present invention.

FIG. 7 is a sectional view, showing an operation of a book holder included in the art painting apparatus in accordance with the fourth embodiment of the present invention. As shown in the drawing, the book holder 72 is made by bending a plate, and supports a book 70 thereon during a book art painting process. A rack 44 is vertically fixed to the lower surface of the top wall of the book holder 72, and engages with a pinion gear 43 rotated by a reversible motor 42. The reversible motor 42, pinion gear 43 and rack 44 form a position adjusting unit 40 of the book holder 72, which adjusts the vertical position of the book holder 72 such that the cover of the book 70 is placed at a desired height. That is, the motor 42 rotates the pinion gear 43 in either direction, thus allowing the rack 44 to appropriately move upward or downward along with the book holder 72. Therefore, the book holder 72, loaded with a book 70 thereon, is appropriately moved in a vertical direction to reach a desired painting position, at which the cover of the book 70 is painted with letters or pictures. In such a case, the position adjusting unit 40 also has a height sensor 46, which senses the height of the book holder 72 so as to control the vertical movement of the book holder 72 such that the holder 72 can be precisely stopped at the painting position.

The book holder 72, loaded with the book 70 thereon, is movably fitted over a fixed base 45, with the reversible motor 42 fixed to the base 45. The book holder 72 is thus moved upward or downward in a vertical direction relative to the fixed base 45. The fixed base 45 is connected at its rear end to the bracket 20 of the painting holder feeding unit 4.

Figure 8:
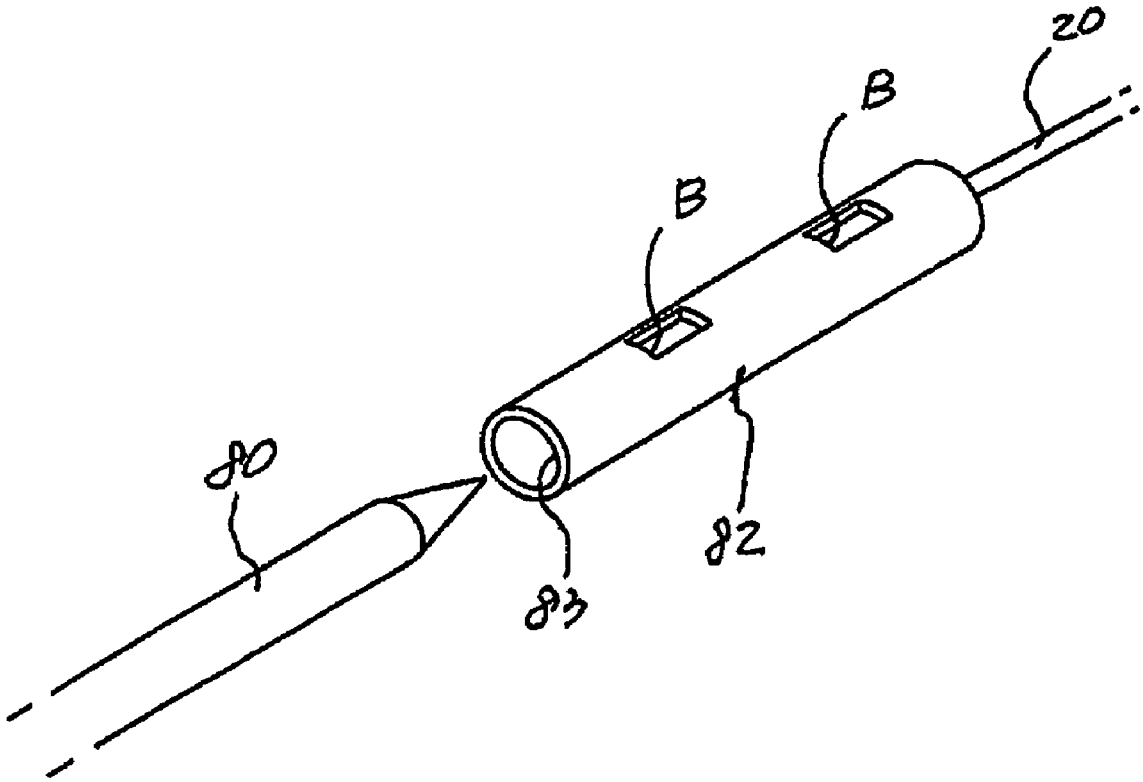
FIG. 8 is a sectional view of a pen holder included in the art painting apparatus in accordance with the fifth embodiment of the present invention.

FIG. 8 is a perspective view, showing an operation of a pen holder included in the art painting apparatus in accordance with the fifth embodiment of the present invention. As shown in the drawing, the pen holder 82 has a longitudinal cylinder-shaped body, which is designed to prevent an undesired movement of a pen 80 in the pen holder 82, with a position adjusting unit included in the pen holder 82 for adjusting the vertical position of the pen holder 82 such that the pen 80 is placed at a desired height. A plurality of painting openings "B" are formed at desired positions of the body. When it is desired to paint letters or pictures on the external surface of a pen 80, the pen 80 is axially inserted into the cylindrical pen holder 82 through a pen inlet 83 provided at a first end of the holder 82. The pen holder 82 is connected at its second end to the bracket 20 of the painting holder feeding unit 4.

INDUSTRIAL APPLICABILITY

As described above, the present invention provides an art painting apparatus for automatic vending machines, which has a printer unit consisting of a painting holder and a painting holder feeding unit. The art painting apparatus of this invention paints a variety of clear patterns, having a high resolution of 900~3,600 dpi, preferably not less than 1,200 dpi, on a desired surface, thus accomplishing a highly active and clear painting effect. The apparatus of this invention has a simple construction and is easily operated, and so it is possible to reduce the production cost of the apparatus. This apparatus is not likely to be broken during an operation, and so the maintenance cost of the apparatus is reduced. The apparatus thus has a high economic efficiency. Another advantage of this art painting apparatus resides in that it easily and effectively paints a variety of letters, pictures, patterns, or personally designed characters on desired surfaces, such as users' fingernails, faces or arms, or the covers of books or pens, as desired. The apparatus of this invention thus allows users to express their personalities through the painting.

Although a preferred embodiment of the present invention has been described for illustrative purposes, those skilled in the art will appreciate that various modifications, additions and substitutions are possible, without departing from the scope and spirit of the invention as disclosed in the accompanying claims.

The invention claim is:

1. A painting holder feeding unit for art painting apparatuses, comprising:

a stepping motor supported on a rear portion of a gear frame, and used for driving a first reduction gear, a second reduction gear and a belt drive gear;

a timing belt set within a tray frame and operated in conjunction with the belt drive gear such that the timing belt is rotated under the guide of a tray guide shaft;

a belt roller set within the tray frame while being biased by a coil spring, said belt roller biasing the timing belt in a direction to appropriately tension said belt;

a painting position sensor and a stop position sensor installed in the tray frame at front and rear positions, and used for determining a linear movement range of the timing belt;

and a bracket provided at a front portion of a tray for connecting a painting holder to the front portion of said tray, thus allowing the painting holder to move along with the tray in the same direction.

2. A printer unit for art painting apparatuses, comprising signal input terminals for receiving input signals, an ink cartridge having an ink nozzle for spraying ink to a desired position, a control unit controllably operating the ink cartridge in response to input signals received by the signal input terminals, and a cartridge guide rail detachably seating the ink cartridge thereon and guiding a reciprocating movement of the ink cartridge linear, further comprising:

a painting holder feeding unit consisting of:

a stepping motor supported on a rear portion of a gear frame, and used for driving a first reduction gear, a second reduction gear and a belt drive gear;

a timing belt set within a tray frame and operated in conjunction with the belt drive gear such that the timing belt is rotated under the guide of a tray guide shaft;

a belt roller set within the tray frame while being biased by a coil spring, said belt roller biasing the timing belt in a direction to appropriately tension the belt;

a painting position sensor and a stop position sensor installed in the tray frame at front and rear positions, and used for determining a linear movement range of the timing belt; and a bracket provided at a front portion of a tray for connecting the painting holder to the front portion of said tray, thus allowing the painting holder to move along with the tray in the same direction; and the painting holder consisting of:

a box-shaped housing opened at a top thereof and connected at a rear portion thereof to the bracket of said painting holder feeding unit;

a spring-biased finger base movably set within said housing, with a compression coil spring held at a bottom surface of said finger base by a setscrew so as to elastically bias the finger base upward in a vertical direction within said housing;

a locking member rotatably mounted at a first end thereof to an external surface of a right-hand sidewall of said housing using a first hinge pin, and normally biased in a direction by a first torsion coil spring, a second end of said locking member being positioned at an upper portion of the housing; and a finger cover hinged at a first end thereof to an external surface of a left-hand sidewall of said housing using a second hinge pin, and biased in a direction by a second torsion coil spring, said finger cover also having a painting opening at a predetermined position thereof, and locked at a second end thereof by the second end of the locking member.

* * * * *